US005299534A

United States Patent [19]

Janka

[11] Patent Number: 5,299,534

[45] Date of Patent: Apr. 5, 1994

[54] SINGLE-DRUM RECOVERY BOILER

[75] Inventor: Pentti Janka, Tampere, Finland

[73] Assignee: Tampella Power Oy of Lipintie, Tampere, Finland

[21] Appl. No.: 6,516

[22] Filed: Jan. 21, 1993

[51] Int. Cl.[5] ..... F22D 1/00; F22G 7/14

[52] U.S. Cl. ..... 122/477; 122/20 B; 122/460; 122/470

[58] Field of Search ..... 122/477, 460, 470, 20 B

[56] References Cited

U.S. PATENT DOCUMENTS 2,594,471 4/1952 Marshall ..... 122/477 X 3,103,207 9/1963 Guarraia ..... 122/477

FOREIGN PATENT DOCUMENTS 0093570 3/1989 European Pat. Off. .

*Primary Examiner*—Edward G. Favors

*Attorney, Agent, or Firm*—Banner, Birch, McKie & Beckett

[57] ABSTRACT

A single-drum recovery boiler comprising a superheater (2), boiler bank elements (3*a*) forming a boiler bank, and elements (3*b*) forming an economizer. In the recovery boiler, a plurality of boiler bank elements (3*a*) and economizer elements (3*b*) are disposed alternately so that a boiler bank—economizer unit (3) is achieved where the ratio between the boiler bank elements and the economizer elements is optimized in relation to the operating conditions of the boiler.

6 Claims, 2 Drawing Sheets

SINGLE-DRUM RECOVERY BOILER

Figure 1:
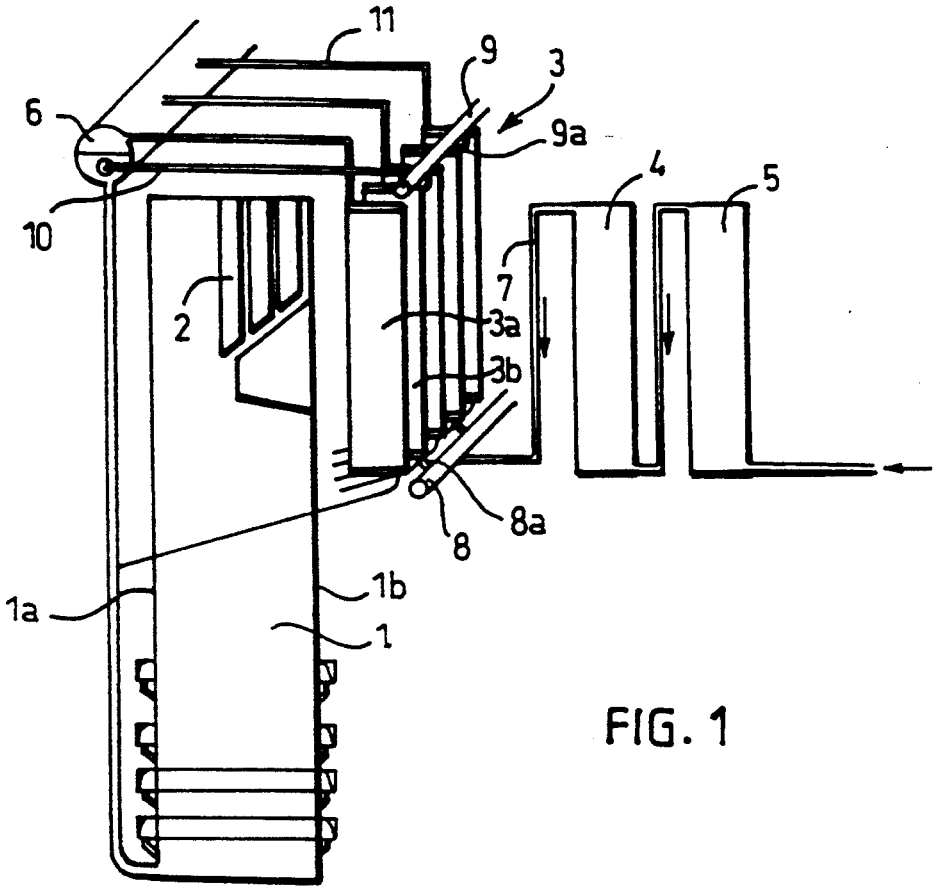

The invention relates to a single-drum recovery boiler comprising a superheater disposed in the flue gas stream; and a boiler bank and an economizer disposed in the flue gas stream after the superheater, the boiler bank comprising boiler bank elements disposed in parallel with the flue gas stream and side by side with each other in a direction transverse to the flue gas stream, and the economizer comprising economizer elements similarly disposed in parallel with the flue gas stream and side by side with each other in a direction transverse to the flue gas stream.

Single-drum recovery boilers employ various heat recovery means, i.e. heat surfaces each recovering a certain portion of the heat generated by the boiler process. Such heat surfaces include the boiler wall tubes, screen tubes, superheaters, boiler banks, and water preheaters called economizers.

Boiler heat surfaces are interconnected in series on a counterflow principle so that the recovery of energy is as efficient as possible. Accordingly, the superheaters are disposed within the area of highest temperature in the furnace while the economizers are disposed last to recover the heat that has cooled most. Correspondingly, water flows through them in the opposite direction so that the feed water is heated in the economizer close to the boiling point before it is introduced into the boiler bank through the drum. The boiler bank evaporates the water into saturated steam which is again passed through the drum into the superheaters, where the steam is converted into superheated steam, which is passed into a steam turbine. Such a structure is known e.g. from EP Patent Specification 93 570, which discloses a single-drum boiler where the economizer and the boiler bank consist of separate elements disposed in the flue gas stream so as to form integral units. This arrangement is well-known and obvious to one skilled in the art, and the patent specification is hereby incorporated by reference.

A conventional recovery boiler construction is based on the fact that as the superheaters, boiler banks and economizers are disposed one after another in the flue gas stream, they are constructed as separate units mounted in place on erecting the boiler. Their properties and dimensions are such as required by each specific process. Today, however, it is increasingly common to burn black liquors containing considerable amounts of dry solids, which improves the transfer of heat in the furnace. As the wall tubes of the furnace also serve as a steam generating surface, a separate boiler bank surface is needed less frequently on account of the increased heat transfer. In addition, the pressure applied in the steam tubing is today higher, and so the temperature of saturated steam is higher and a greater amount of heat can be transferred into the economizer. The increased height of the recovery boilers is another factor increasing the area of the wall tubes, which, in turn, increases the steam generating area.

Another drawback of the existing boiler is that the boiler penthouse is often too small, as each boiler bank element has to be provided with a separate riser to the steam drum. Similarly, the great number of steam separation cyclones disposed within the drum increase its size. This problem could be solved e.g. by optimizing the boiler bank and economizer area, in which case the boiler bank area should be decreased and the economizer area should be increased. In practice, this would increase the cost of the boiler bank surface as compared with the existing boilers, and the flue gas duct should be enlarged as it should accommodate a greater number of economizers, which would again increase the cost of manufacture.

The object of the present invention is to provide a single-drum recovery boiler which avoids the above-mentioned problems and which provides an optimal end result both from the structural and the functional point of view. The single-drum recovery boiler according to the invention is characterized in that a plurality of boiler bank elements and a plurality of economizer elements are mounted side by side with each other in a direction transverse to the flue gas stream so that the flue gas stream heats the boiler bank elements and the economizer elements simultaneously within this particular flue gas duct section.

The basic idea of the invention is that in place of the fully separate, successive economizer and boiler bank units, a plurality of boiler bank and economizer elements are disposed side by side in the same unit, so that the boiler bank area, i.e. the number of the boiler bank elements and economizer elements, respectively, can be easily adapted to the operating conditions of the boiler, and the capacity of the boiler bank and the economizer can be properly adapted to each other. Even in this case the boiler bank and economizer elements may be constructed as a prefabrication unit so dimensioned that their elements can be easily disposed between each other.

An advantage of the invention is that the boiler bank—economizer unit is easy and simple to realize without having to enlarge the flue gas duct. At the same time an appropriate capacity ratio can be achieved between the boiler bank and the economizer/s, and the realization of the system is economical.

Figure 2:
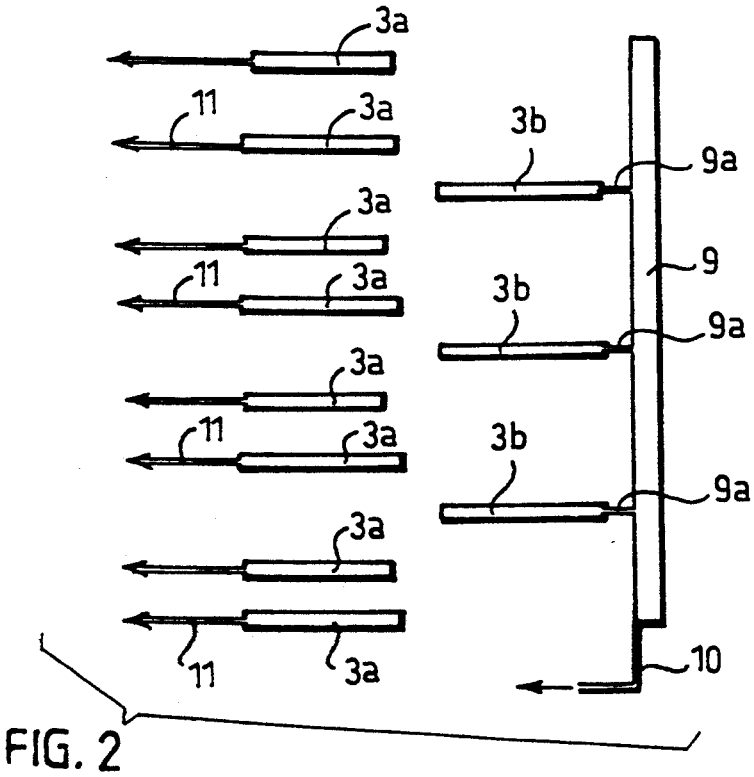
Figure 3:
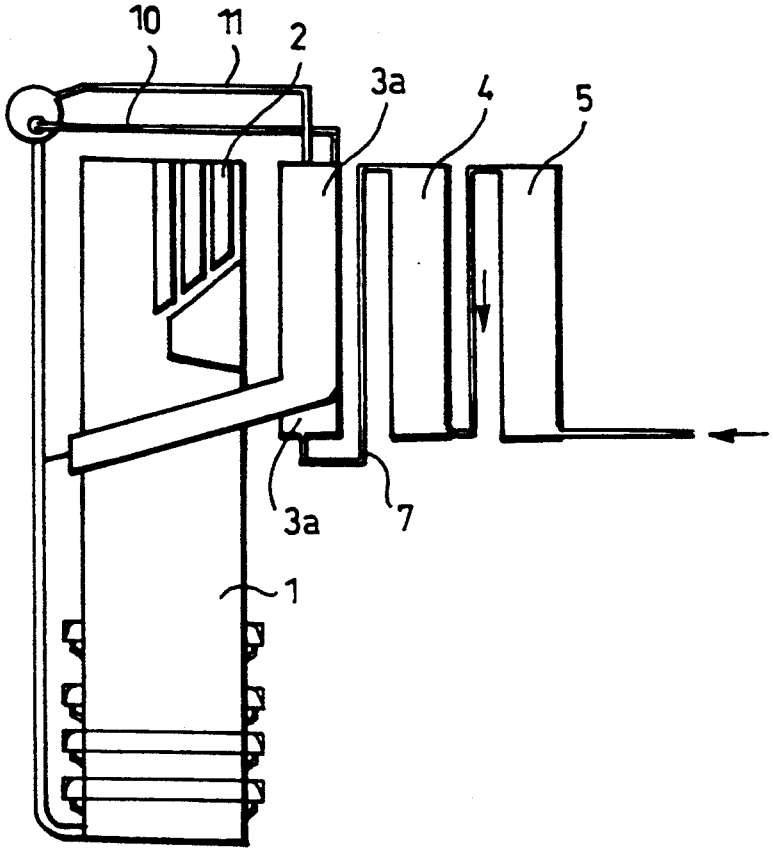

The invention will be described in more detail with reference to the attached drawings, where FIG. 1 illustrates schematically one embodiment of a recovery boiler according to the invention;

FIG. 2 is a schematic top view of the economizer and boiler bank elements of the recovery boiler shown in FIG. 1 when taken apart; and FIG. 3 illustrates schematically another embodiment of the recovery boiler according to the invention.

FIG. 1 shows a recovery boiler comprising a furnace 1 with walls 1*a* and 1*b* formed by wall tubes in a manner known per se. At the top of the furnace 1 there is provided a superheater 2 through which flue gases flow immediately on emerging from the furnace. The superheater 2 may comprise one or more successive superheater units, e.g. three successive superheater units, as shown in FIG. 1. The following unit in the direction of stream of the flue gases is a boiler bank—economizer unit 3 comprising both boiler bank elements 3*a* and economizer elements 3*b* disposed side by side. Next in the flue gas stream there are provided economizers 4 and 5 through which the flue gases flow in the stated order. Correspondingly, the feed water passes first through the economizer 5 and then though the economizer 4 and further into the economizer elements 3*b* of the boiler bank—economizer unit 3, wherefrom the water is discharged into a drum 6. From the economizer 4 the water is passed through a conduit 7 into an inlet chamber 8 and then through separate tubes 8*a* into the economizer elements 3*b*. Correspondingly, the water from all economizer elements 3*b* is passed through a tube 9a extending from the top portion of each economizer element 3b into a discharge chamber 9, wherefrom it passes through a conduit 10 into the drum 6. From the drum 6 the water is passed in a manner known per se into the boiler bank elements 3a, and the generated steam is passed through the drum 6 into the superheaters 2 in a manner known per se.

In the invention, a plurality of boiler bank elements 3a and economizer elements 3b are disposed side by side in the same unit so that the boiler bank capacity required in view of the entire boiler structure will be appropriate for the black liquor to be used while the space unoccupied by the boiler banks is occupied by the economizer, and so the ratio between the economizers and the boiler bank will be adapted to the conditions. In this arrangement, the boiler bank elements 3a and the economizer elements 3b may be nearly similar in structure, and merely to simplify the tube system, the inlet chamber 8 is connected to the inlet and discharge conduits of the economizer elements 3b for supplying water to the economizer elements 3b, and the discharge chamber 9 is connected to them for receiving the water from them and passing it through a common conduit to the drum. In principle, the water could be supplied by providing each economizer with a separate tube both a& the inlet and discharge end; the above-described arrangement, however, provides a compact assembly and avoids the need for installing a great number of tubes, as both feed water and discharge water can be passed through a single tube. Each boiler bank element 3a is connected by a separate tube directly to the drum 6. The connection may also be made similarly as in the economizer, i.e. by collecting the water-steam mixture from the upper chamber of several elements into a common tube through which the mixture is passed to the drum. In the combination of an economizer and a boiler bank, the ratio between the elements can be set in various ways on the basis of the other structural features of the boiler, the process parameters, i.e. the steam and water parameters, and the black liquor to be burnt. The boiler bank elements 3a and the economizer elements 3b may be placed e.g. alternately, or they may be placed so that e.g. two boiler bank elements 3a are followed by one economizer element 3b, then again two boiler bank elements, one economizer element, etc., that is, the ratio between the elements in this case would be 2:1. Correspondingly, the ratio between the elements may be 3:1, 4:1, etc., or it may be reversed so that there are two economizer elements for one boiler bank element, etc., the element ratio being 1:2, 1:3, 1:4, etc. The selection of the element ratio depends fully on the other structural features of the boiler, the process parameters, that is, the steam and water parameters, and the combustion conditions, and it is selected on designing the boiler. The element ratio is not, of course, always a ratio between integers, as the number of elements may vary with different uses. Due to the symmetrical structure of the unit, the element ratio is not usually a ratio between integers. However, this is not significant for the operation of the recovery boiler according to the invention, since the number and areas of the elements are determined in accordance with the conditions.

Depending on the size of the boiler, this kind of boiler bank—economizer combination may be assembled into a single fixed unit similarly as the existing economizers and boiler banks may each be assembled into a single unit which is lifted in place as such on erecting the boiler, whereafter the required inlet and discharge tube connections are made. This simplifies the assembly of the boiler, thus reducing the associated tubing and installation work.

FIG. 2 is a schematic top view of a specific boiler bank—economizer unit 3 with the boiler bank and economizer elements taken apart. It appears clearly from the figure how the elements 3a and 3b are positioned in relation to each other. It further appears that there is an empty space after two adjacent boiler bank elements 3a, and after the empty space there are two further boiler bank elements 3a. It can also be seen from the figure that there is one economizer element 3b at each empty space left between the boiler bank elements. The economizer elements 3b are connected by tubes 9a extending from their upper ends to a discharge chamber 9, into which the water flown through all economizer elements 3b is thus passed and further through the tube 10 shown in the figure away from the discharge chamber 9 into the drum. Correspondingly, as appears from FIG. 1, an inlet chamber 8, not shown in FIG. 2, is provided at the bottom of the economizer elements 3b, from which chamber water is supplied through suitable tubes to the lower end of each economizer element. Tubes 11, in turn, extend from each boiler bank element 3a into the drum 6 for passing steam from the boiler bank into the drum.

On assembling the boiler bank elements 3a and the economizer elements 3b, they are inserted within each other so that the distances between the elements 3a and 3b will be approximately uniform, because this is advantageous for the stream of flue gases. The elements are suspended in position by a known boiler construction technique.

FIG. 3 shows another embodiment of the recovery boiler structure according to the invention; in principle, it is realized similarly as in FIGS. 1 and 2, but the boiler bank is formed by screen tubes. In this embodiment, the economizer elements 3b and the boiler bank elements 3a differ from each other in shape to some extent, but they can, however, be assembled into an integral unit similarly as in the embodiment of FIG. 1.

The invention has been described above and in the drawings by way of example, and it is in no way restricted to this example. The scope of protection of the invention is defined in the claims, and so the invention can be applied accordingly in various recovery boiler structures and various boiler bank—economizer embodiments provided that the matters defined in the claims are taken into account.

I claim:

1. Single-drum recovery boiler comprising:

a superheater disposed in the flue gas stream; and a boiler bank and an economizer disposed in the flue gas stream after the superheater, the boiler bank comprising boiler bank elements disposed in parallel with the flue gas stream and side by side with each other in a direction transverse to the flue gas stream, and the economizer comprising economizer elements similarly disposed in parallel with the flue gas stream and side by side with each other in a direction transverse to the flue gas stream, wherein a plurality of boiler bank elements and a plurality of economizer elements are mounted side by side with each other in a direction transverse to the flue gas steam so that the flue gas stream heats the boiler bank elements and the economizer elements simultaneously within this particular flue gas duct section.

2. Recovery boiler according to claim 1, wherein, the boiler bank elements are interconnected into a first integral unit where there are provided empty spaces with suitable spacings between the boiler bank elements for the economizer elements; and the economizer elements are interconnected into a second integral unit, the spacings between the economizer elements in the second integral unit corresponding to the spacings between the empty spaces in the first integral unit formed by the boiler bank elements so that the first integral unit formed by the boiler bank elements and the second integral unit formed by the economizer elements are disposable within each other.

3. Recovery boiler according to claim 1 or 2, wherein each boiler bank element is connected directly to a steam drum, and feed water is correspondingly supplied directly to each boiler bank element.

4. Recovery boiler according to claim 1, wherein the boiler bank elements and the economizer elements are interconnected into an integral unit.

5. Recovery boiler according to claim 1, wherein the boiler bank elements and the economizer elements are substantially similar in structure and shape.

6. Recovery boiler according to claim 1, further comprising:

an inlet chamber connected to the economizer elements, water to be supplied to the economizer elements being fed into the inlet chamber;

a first tube provided between the inlet chamber and each economizer element for passing water from the inlet chamber to a lower end of the economizer element;

a discharge chamber provided with a discharge conduit, the discharge conduit being connected to the steam drum; and a second tube provided between the discharge chamber and each economizer element for passing water from an upper end of the economizer elements into the discharge chamber.

* * * * *

UNITED STATES PATENT AND TRADEMARK OFFICE

CERTIFICATE OF CORRECTION

PATENT NO. : 5,299,534
DATED : April 5, 1994
INVENTOR(S) : JANKA, Pentti

It is certified that error appears in the above-indentified patent and that said Letters Patent is hereby corrected as shown below:

ON THE COVER PAGE

Please amend the Assignee item [73]:

"Tampella Power Oy of Lipintie,
Tampere, Finland"

to

--Tampella Power Oy of Lapintie,
Tampere, Finland--

Signed and Sealed this

Eighteenth Day of April, 1995

Bruce Lehman

BRUCE LEHMAN

*Commissioner of Patents and Trademarks*

*Attest:*

*Attesting Officer*